US010251488B2

(12) United States Patent
Lan

(10) Patent No.: US 10,251,488 B2
(45) Date of Patent: Apr. 9, 2019

(54) YOGA STOOL

(71) Applicant: Lou Lan, Paia, HI (US)

(72) Inventor: Lou Lan, Paia, HI (US)

( * ) Notice: Subject to any disclaimer, the term of this patent is extended or adjusted under 35 U.S.C. 154(b) by 0 days.

(21) Appl. No.: 14/950,536

(22) Filed: Nov. 24, 2015

(65) Prior Publication Data

US 2016/0143444 A1 May 26, 2016

Related U.S. Application Data

(60) Provisional application No. 62/084,121, filed on Nov. 25, 2014.

(51) Int. Cl.

| | |
|---|---|
| ***A47C 9/00*** | (2006.01) |
| ***A47C 9/10*** | (2006.01) |
| ***A47C 31/00*** | (2006.01) |
| *A61H 15/00* | (2006.01) |

(52) U.S. Cl.

CPC ..... *A47C 9/002* (2013.01); *A47C 31/00* (2013.01); *A61H 15/00* (2013.01); *A61H 2015/0014* (2013.01); *A61H 2201/0149* (2013.01); *A61H 2205/12* (2013.01)

(58) Field of Classification Search

CPC ..... A47C 9/002; A47C 31/00; A61H 15/00; A61H 2015/0014; A61H 2201/0149; A61H 2205/12

USPC ..... 297/1, 3, 183.1, 183.6, 188.08, 423.39, 297/423.41, 462; 482/142, 148

See application file for complete search history.

(56) References Cited

U.S. PATENT DOCUMENTS

| | | | | | |
|---|---|---|---|---|---|
| 482,912 | A | * | 9/1892 | Bornemann | F24B 15/04 297/462 X |
| 1,429,651 | A | * | 9/1922 | Slaght | A47C 13/00 297/461 |
| 2,108,241 | A | * | 2/1938 | Leta | A47C 16/02 297/1 X |
| D131,473 | S | * | 3/1942 | Thelander | 297/462 |
| 2,327,288 | A | * | 8/1943 | Post | B60N 2/283 297/188.08 X |
| D151,983 | S | | 12/1948 | Guertin | |
| 2,509,395 | A | * | 5/1950 | Madan | A47C 3/16 229/5.5 |

(Continued)

FOREIGN PATENT DOCUMENTS

| | | |
|---|---|---|
| CN | 202354956 U | 8/2012 |
| CN | ZL 201530086575.5 | 4/2015 |
| DE | 44 14 096 A1 | 9/1994 |

*Primary Examiner* — Rodney B White

(74) *Attorney, Agent, or Firm* — Amster, Rothstein & Ebenstein LLP

(57) ABSTRACT

A yoga stool may have a seat portion and a base portion; the base portion having window slot(s) formed in a front side, a rear side, or both; a handle slot formed at least in one side, such as the front side, at or near the top; horizontal gripping slot(s) formed in the left side, the right side, or both, at or near the top; and vertical gripping slot(s) formed in the left side, the right side, or both, at or near the bottom; advantageously four such slots being formed near the bottom corners of the left and right sides. A yoga stool also may have a base portion, and a seat portion on top of the base portion, wherein the seat portion has an internal firm support member such as a solid slat, and preferably softer material such as foam rubber surrounding the support member, at least on the left and right sides.

20 Claims, 11 Drawing Sheets

(56) References Cited

U.S. PATENT DOCUMENTS 2,532,863 A * 12/1950 Auburn ..... A47C 4/021 297/183.1 X
2,577,741 A * 12/1951 Creveling ..... A47C 17/60 297/462 X
2,607,946 A * 8/1952 Price ..... A47C 7/506 297/188.08 X
2,725,923 A * 12/1955 Bachrach ..... A47C 13/00 248/146
2,776,700 A * 1/1957 Potter ..... A47C 4/021 297/183.1
2,877,830 A * 3/1959 Smith ..... A47C 16/025 248/371
3,077,347 A * 2/1963 Nova ..... A63B 21/00047 482/142
3,099,398 A * 7/1963 Lionel ..... B25H 3/02 297/462
3,890,004 A 6/1975 Rail ..... 297/423
3,982,784 A * 9/1976 Esser ..... A47B 83/02 297/1 X
4,133,524 A * 1/1979 Barlew ..... A63B 21/00054 482/142
D251,321 S * 3/1979 Barlew ..... D21/686
D257,439 S 10/1980 Horii ..... D21/127
D276,861 S * 12/1984 Keddie ..... D3/315
D297,080 S 8/1988 Hemberg ..... D6/430
4,763,580 A * 8/1988 Garland ..... A47D 1/004 297/1 X
4,810,031 A 3/1989 Patterson ..... 297/192
4,950,033 A * 8/1990 Anderson ..... A47C 3/04 297/423.41 X
5,176,596 A * 1/1993 Ullman ..... A63B 23/0458 482/52 X
5,186,703 A * 2/1993 Huang ..... A61H 7/001 482/148
D351,508 S 10/1994 Bonazza ..... D6/336
5,615,619 A * 4/1997 King ..... A47B 25/00 108/25
5,692,335 A * 12/1997 Magnuson ..... A01K 97/22 297/188.08
5,697,870 A * 12/1997 Osborn ..... A63B 23/0458 482/51
D407,569 S 4/1999 Underbrink et al. ..... D6/349
D415,359 S 10/1999 Boyd ..... D6/336
D420,396 S 2/2000 Vieslet ..... D21/191
6,155,641 A * 12/2000 Frost ..... A47D 1/04 297/1 X
D485,093 S 1/2004 de Blois ..... D6/485
D490,616 S 6/2004 Ljahnicky et al. ..... D6/329
D493,618 S 8/2004 DeCarlo et al. ..... D3/302
D506,123 S 6/2005 English et al. ..... D8/358
7,097,241 B2 8/2006 Tally et al. ..... 297/118
D558,473 S * 1/2008 Mendenhall ..... D6/349
7,488,282 B2 2/2009 Leavitt ..... 482/142
D587,475 S * 3/2009 Ren ..... D6/349
D610,818 S 3/2010 Crane ..... D6/349
7,814,581 B1 * 10/2010 Willner ..... A47K 17/02 297/423.41
D627,013 S 11/2010 Nys ..... D21/686
7,922,624 B1 * 4/2011 Fairhurst ..... A63B 21/0552 482/52
7,997,216 B2 8/2011 Thornbury et al. ..... 108/157.1
D684,215 S 6/2013 Markowitz ..... D21/333
D688,050 S 8/2013 Gologorsky ..... D6/349
D699,043 S 2/2014 McNae ..... D6/335
D701,582 S 3/2014 Sterios ..... D21/686
D710,031 S * 7/2014 Simpson ..... D25/65
D710,622 S 8/2014 Nigro ..... D6/349
D733,230 S * 6/2015 Mallory ..... D21/686
D736,531 S 8/2015 Lan ..... D6/349
2002/0055427 A1 * 5/2002 Jennings ..... A61H 15/0092 482/148
2002/0177509 A1 11/2002 Rodgers et al. ..... 482/53
2003/0199375 A1 * 10/2003 Edwards ..... A63B 21/0004 482/148
2004/0192523 A1 * 9/2004 Wu ..... A63B 21/00047 482/148
2007/0161476 A1 * 7/2007 Davies ..... A63B 71/0036 482/142
2008/0113854 A1 * 5/2008 Ferri ..... A61F 5/019 482/148
2009/0062093 A1 3/2009 Clark ..... 482/148
2010/0240509 A1 * 9/2010 Chen ..... A63B 21/00047 482/148
2012/0214653 A1 * 8/2012 Tsou ..... A63B 21/00047 482/142
2012/0329623 A1 * 12/2012 Ramirez ..... A63B 21/00047 482/139
2013/0324382 A1 * 12/2013 Wilson ..... A61H 7/007 482/142
2015/0231437 A1 * 8/2015 Welsh ..... A63B 21/00054 482/142

* cited by examiner

YOGA STOOL

CROSS-REFERENCE TO RELATED APPLICATION

This application is based on and claims priority to Provisional Application No. 62/084,121, filed Nov. 25, 2014, herein incorporated by reference.

FIELD OF THE INVENTION

The invention relates to a stool, particularly for use in practicing yoga, having a combination of features adapted for facilitating a wide variety of yoga postures.

BACKGROUND OF THE INVENTION

It is known to practice yoga while seated in a chair, or to incorporate a chair or another structure such as a wall into the yoga practice. However, chairs are not standardized and walls are not always accessible in a given space.

It would be desirable to provide a portable, compact, multi-function support unit to perform the functions of both chairs and walls in order to make the practice of yoga more comfortable and convenient.

It would further be desirable for the support unit to provide specific handholds and footholds to guide and facilitate the yoga practice.

SUMMARY

Accordingly, according to one aspect of the invention, a yoga stool may comprise a seat portion and a base portion; the base portion having opposed top and bottom sides, opposed left and right sides, and opposed front and rear sides; a window slot formed in at least one of the front side and the rear side; a horizontal gripping slot formed in an upper portion of at least one of the left side and the right side; a vertical gripping slot formed in a lower portion of at least one of the left side and the right side. The yoga stool preferably may have at least two vertical gripping slots formed respectively in the lower portions of the left side and the right side, and even more preferably four vertical gripping slots formed in the lower portions of the left side and the right side, two of said slots being near or at the front side and two of the slots being near or at the back side, and/or two horizontal gripping slots formed respectively in the left side and the right side.

According to another aspect, a yoga stool may comprise a base portion, and a seat portion on top of the base portion; the base portion having opposed top and bottom sides, opposed left and right sides, and opposed front and rear sides; wherein the seat portion has an internal horizontal firm support member such as a solid slat, and soft material such as foam rubber surrounding the support member adjacent the left, right, front and rear sides.

Other features and advantages of the invention will be appreciated from the following description of embodiments thereof, with reference to the drawings.

DETAILED DESCRIPTION

Figure 1:
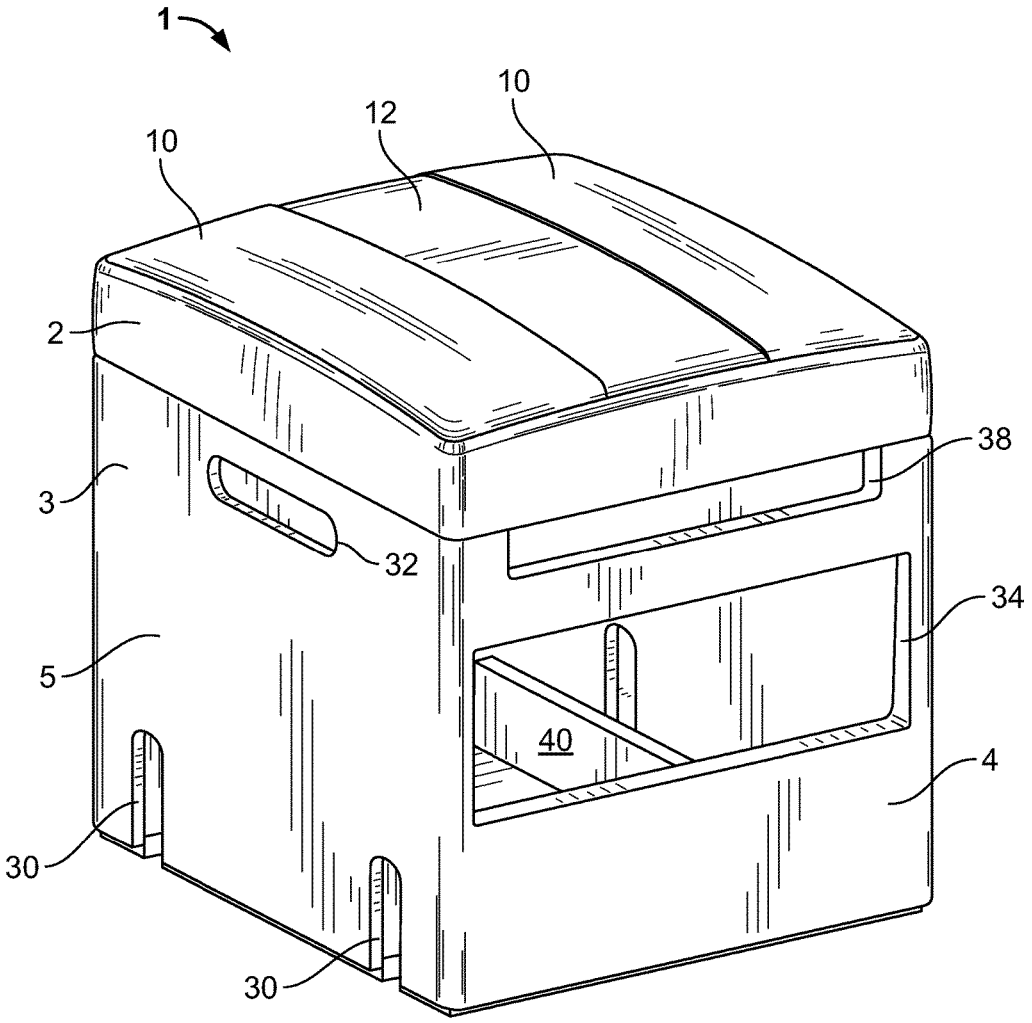
FIG. 1 is a front right perspective view of a yoga stool according to an embodiment of the invention.
Figure 2:
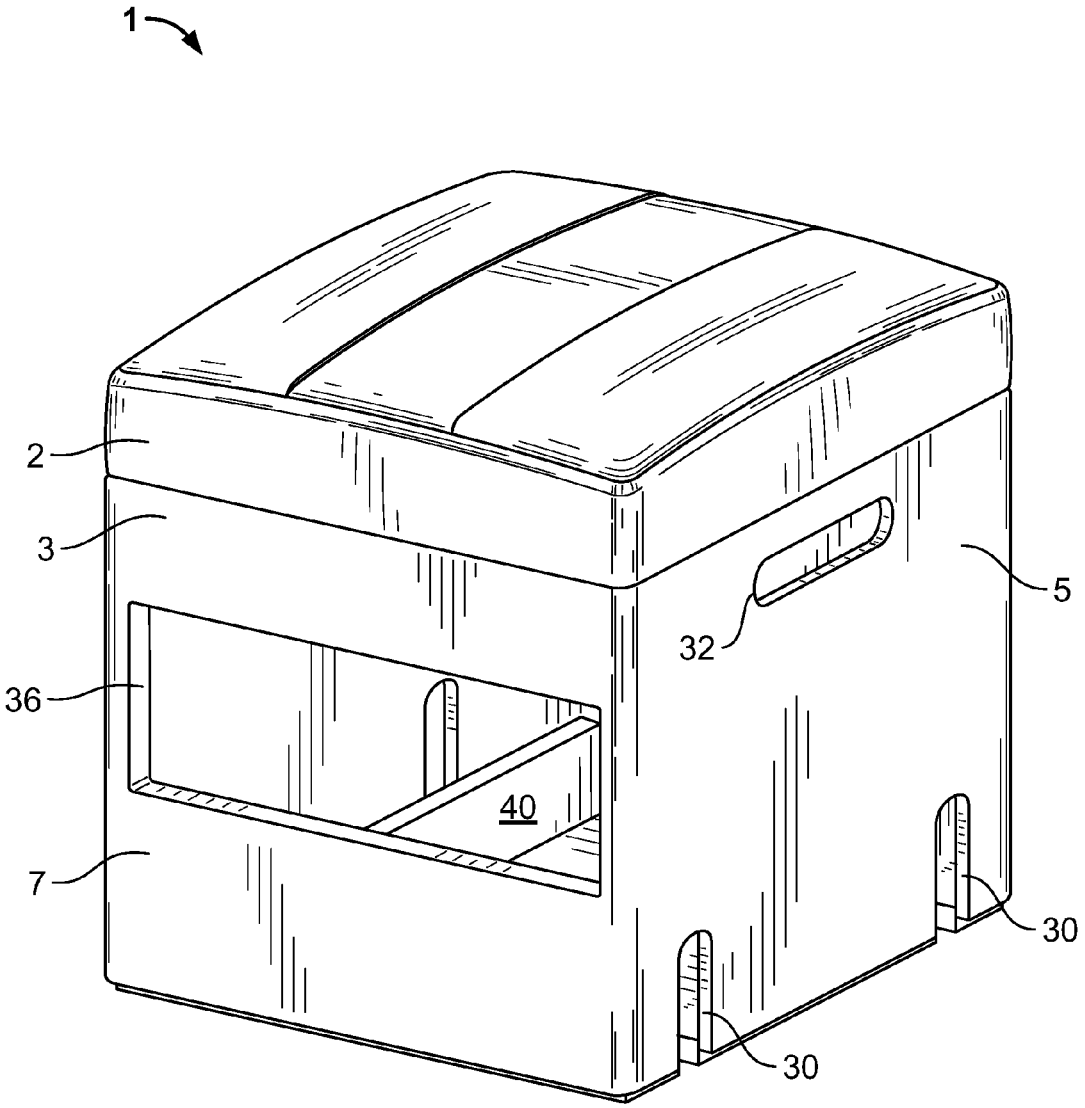
FIG. 2 is a rear right perspective view thereof.
Figure 3:
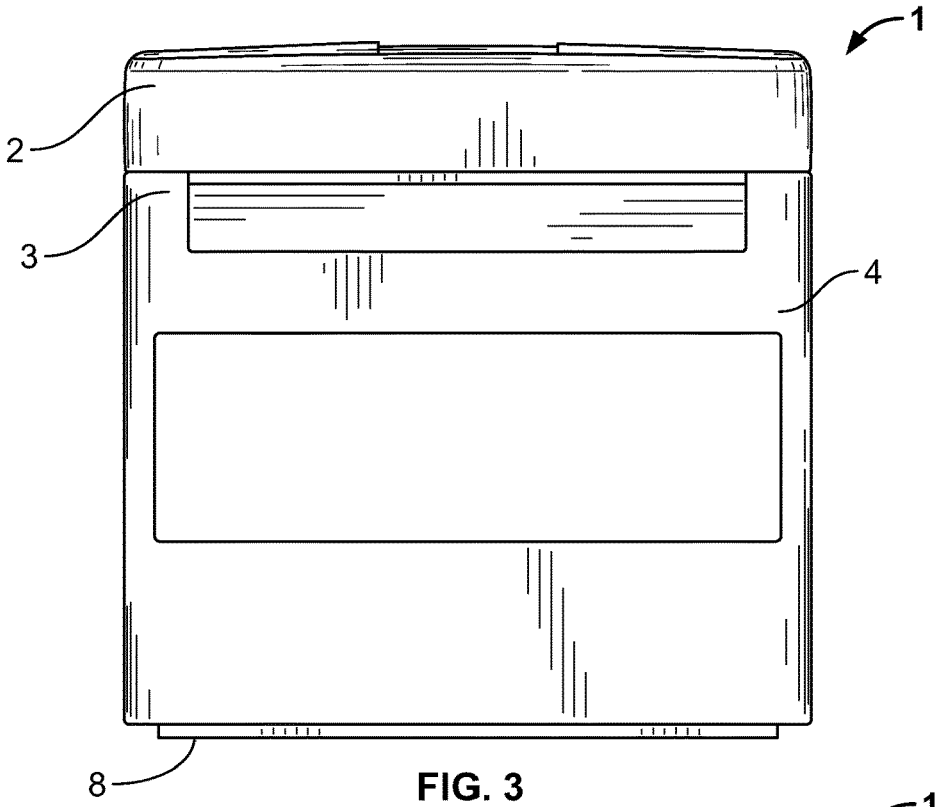
FIG. 3 is a front elevation view thereof.
Figure 4:
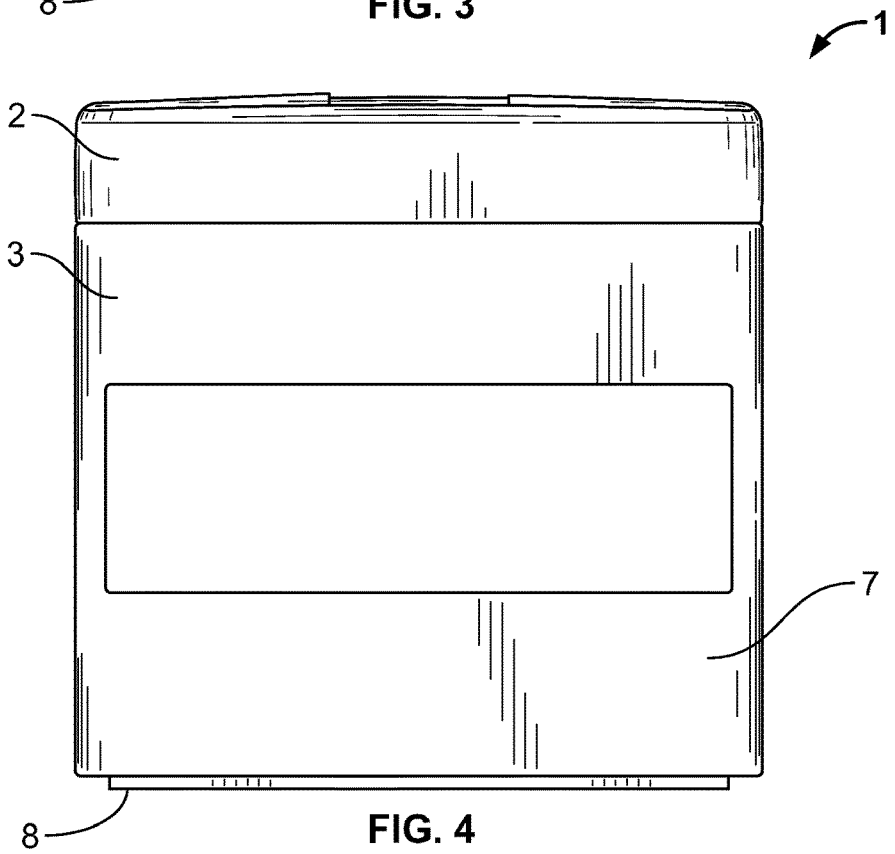
FIG. 4 is a rear elevation view thereof.

FIGS. 1-8 show a yoga stool according to an embodiment of the invention, comprising the following major parts:

yoga stool 1
seat portion (seat) 2
base portion (base) 3
front side of base 4
right side of base 5
left side of base 6
rear side of base 7
bottom of base 8

As seen in the figures, the yoga stool 1 is generally cubical in shape.

Referring to FIG. 1, the seat 2 may be covered for example by a pair of spaced-apart side strips 10 made for example of a rubber material for being securely gripped, and a middle strip 12 which may be made of cotton for a decorative effect. Other suitable materials may be used.

The seat 2 has high density foam rubber or another suitable material beneath the cover strips 10,12.

Figure 5:
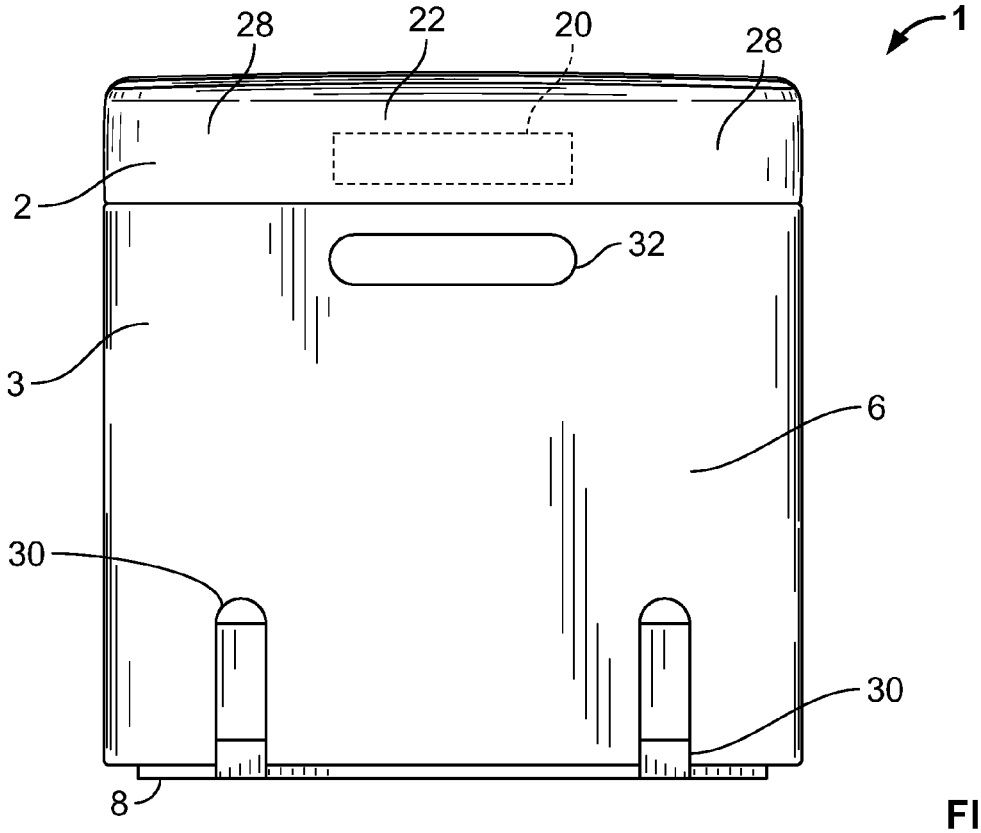
FIG. 5 is a left side elevation view thereof.
Figure 6:
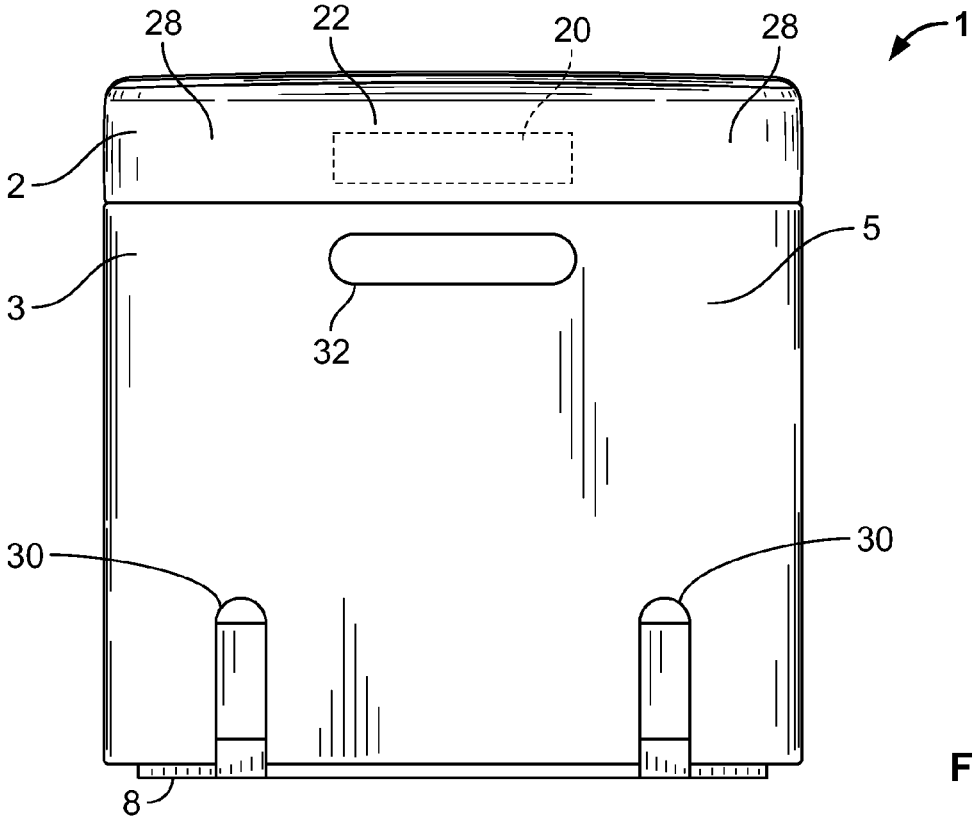
FIG. 6 is a right side elevation view thereof.
Figure 7:
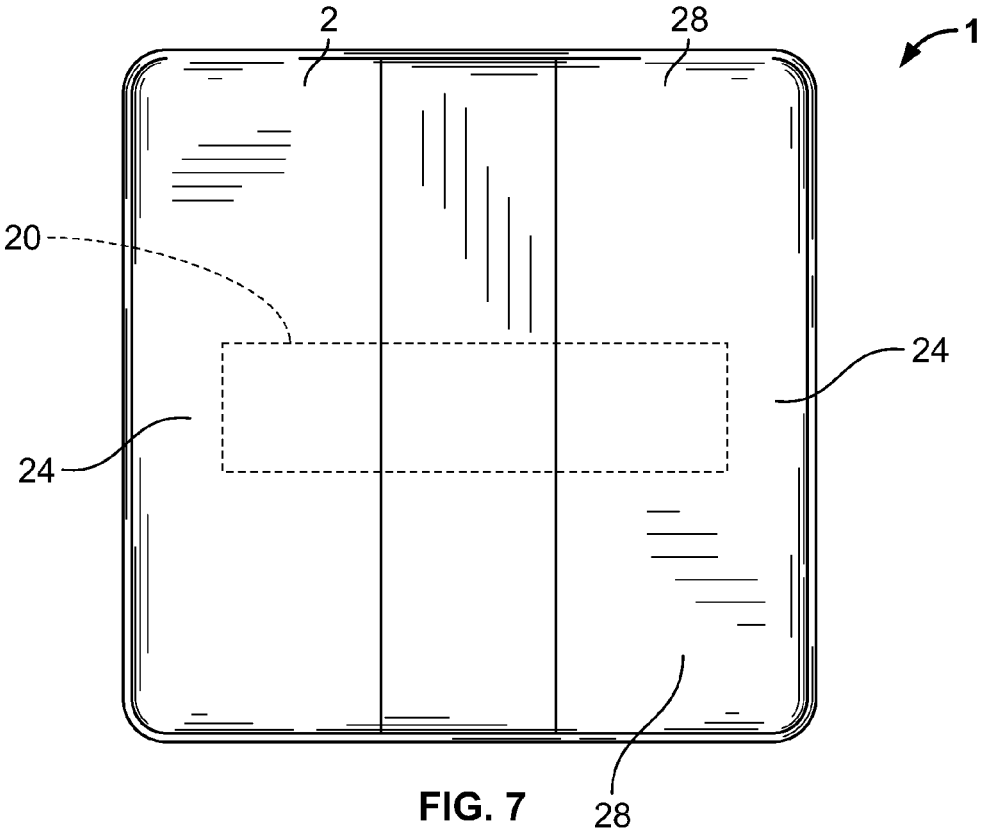
FIG. 7 is a top plan view thereof.
Figure 8:
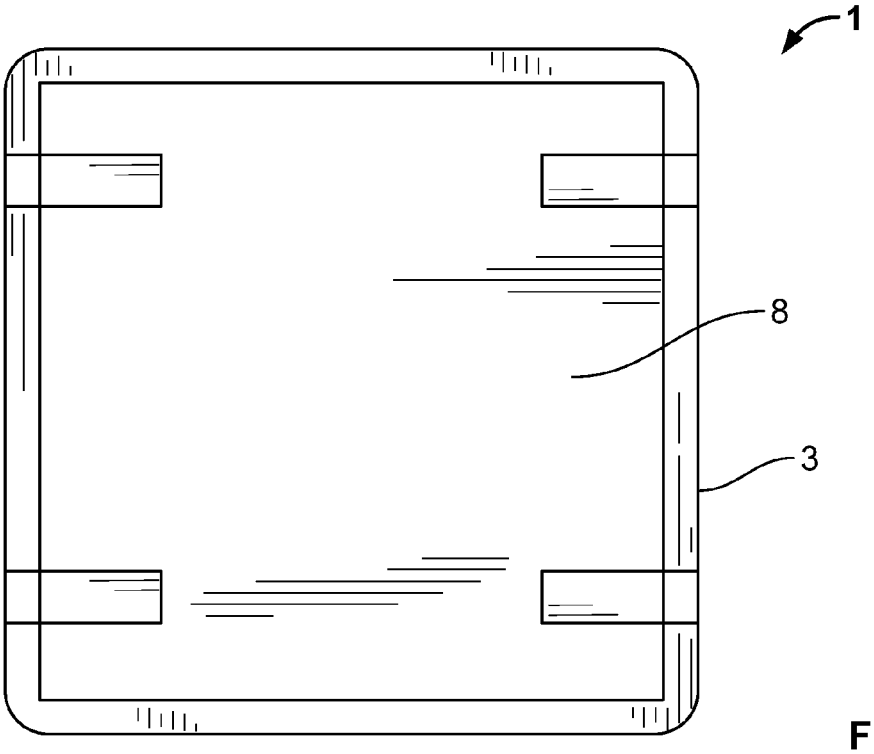
FIG. 8 is a bottom plan view thereof.

As shown in dashed lines in FIGS. 5, 6, and 7, a slat 20 which may be made of wood or another stiff material is arranged in the seat 2 for providing a firm seating surface, as well as firm support for the user's wrist, and/or the heel of the hand. The slat 20 is covered by a top layer 22 of foam rubber or the like. The slat 20 extends part way across the seat 2, between the right and left sides 5,6, leaving side portions 24 and front and rear portions 28 that are filled with foam rubber and provide a comfortable resting and gripping area for the hands.

Optionally, the slat may be omitted from the middle of the seat 2, but instead two or more smaller slats or other suitable supports may be provided within the seat.

The base 3 has four vertical side gripping slots 30 formed in lower portions of the right side 5 and the left side 6, near or at the bottom side 8, to be gripped by the user for performing various yoga postures. In this context, "lower portion" or "near or at the bottom" refers to a suitable location for performing yoga postures in conjunction with the floor.

The upper portions of the right and left sides 5,6 each have a horizontal gripping slot 32 near the top for performing other yoga postures. In this context, "upper portion" or "near or at the top" refers to a suitable location for being gripped by a user seated on the seat.

The front side 4 and the rear side 7 have respective generally rectangular window slots 34,36 extending substantially from side to side of the stool, and occupying approximately the middle third of the surface area of the respective side 4 or 7.

Optionally, rollers for foot massage may be mounted at one or both of the window slots 34,36 at a position accessible from outside the base portion for massaging the feet.

The upper portion of the front side 4 also has a handle slot 38 near or at the top of the base portion 3. In this context, "upper portion" or "near or at the top" refers to an appropriate location for carrying the yoga stool.

Also seen in the drawings are interior braces 40 near or at the bottom 8, for increasing the structural integrity of the stool. The interior of the stool may also be used for storage of other equipment, such as yoga blocks for example. Securing means such as a cover, strap, or zipper for enclosing the stored items may be provided. Anchors such as U-bolts mounted on the braces 40, for example, may also be provided for ropes, bungees, etc. for facilitating other postures and exercises.

The bottom 8 may be surfaced with rubber or another material suitable for providing secure gripping with the floor.

All of the slots and windows described above are preferably lined with foam rubber or another soft material for providing a comfortable grip or other contact point for the user.

Figure 9:
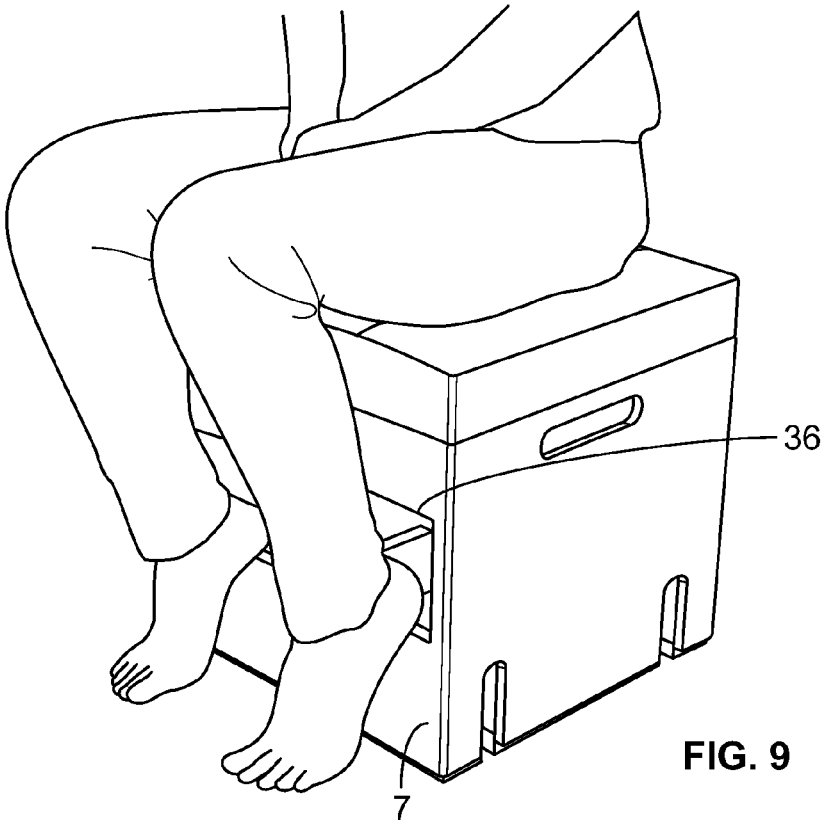
FIG. 9-12 show a user seated on the stool and interacting with the stool in a respective plurality of positions.

Referring now to FIG. 9, a user is shown with heels hooked on the window slot 36 on the rear side 7 for stretching the feet.

Figure 10:
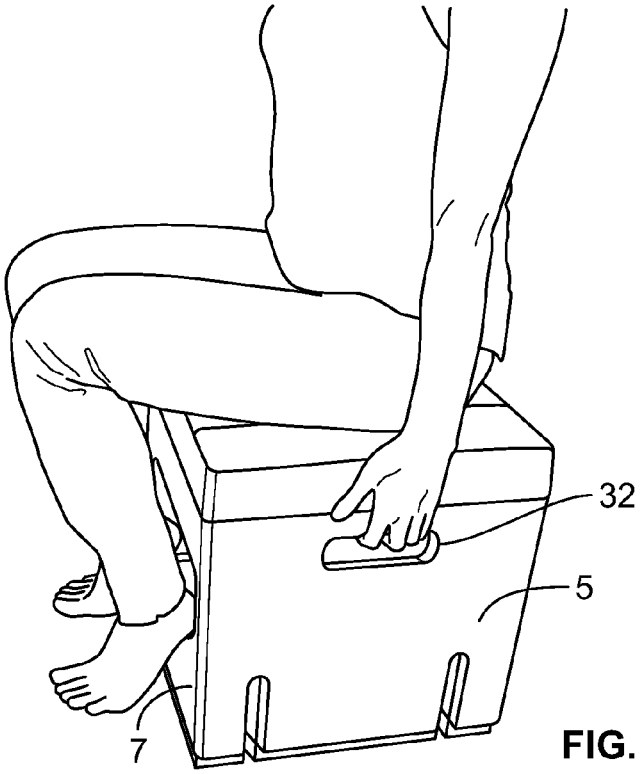

In FIG. 10, the user further has the hands gripped in the side slots 32 for stretching the spine.

Figure 11:
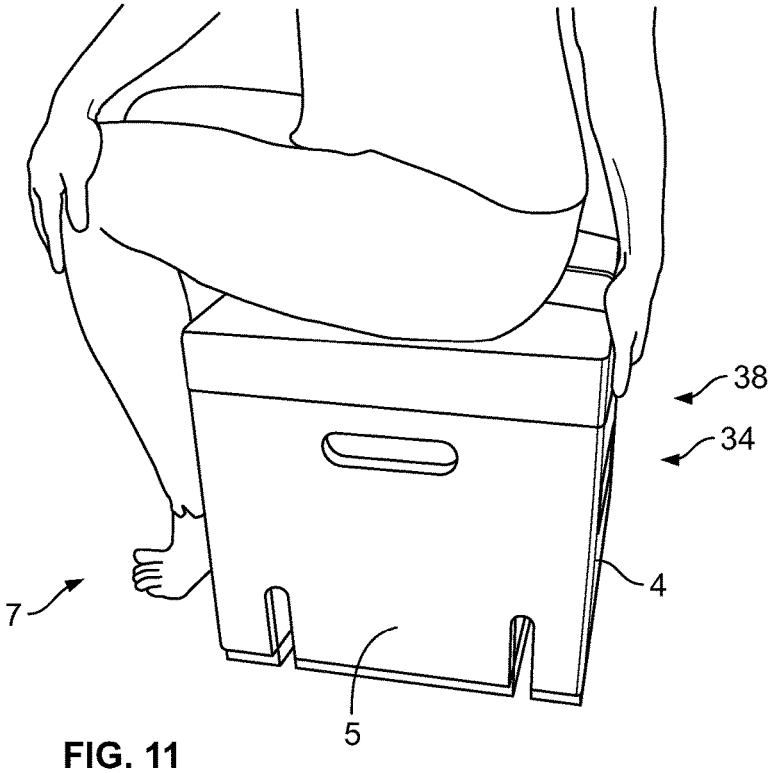

In FIG. 11, the user is performing a spinal twist with the heels on the window slot 36, the right hand on the left knee, and the left hand gripped in the top handle slot 38 on the front side 4.

Figure 12:
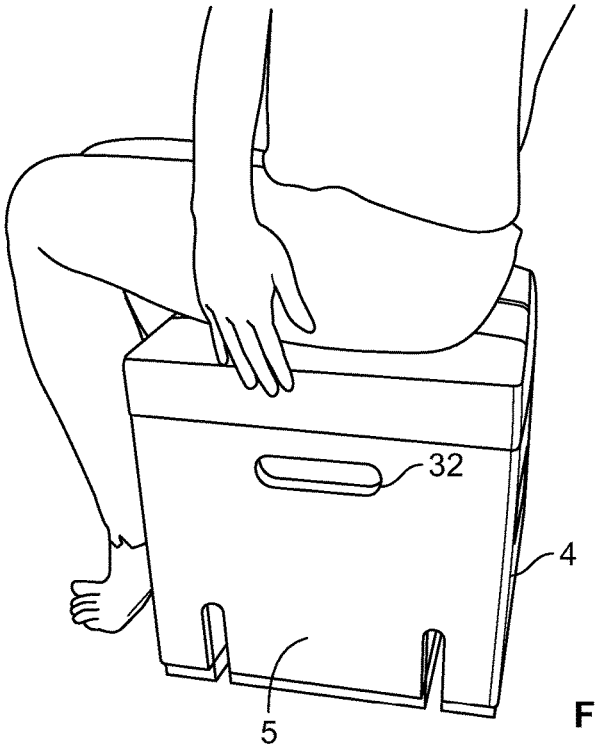

In FIG. 12, the user is performing a further spinal twist with the heels on the window slot 36, the right hand on the right side 5 of the stool, and the left hand gripped in the handle slot 32 on the left side 6 of the stool.

Figure 13:
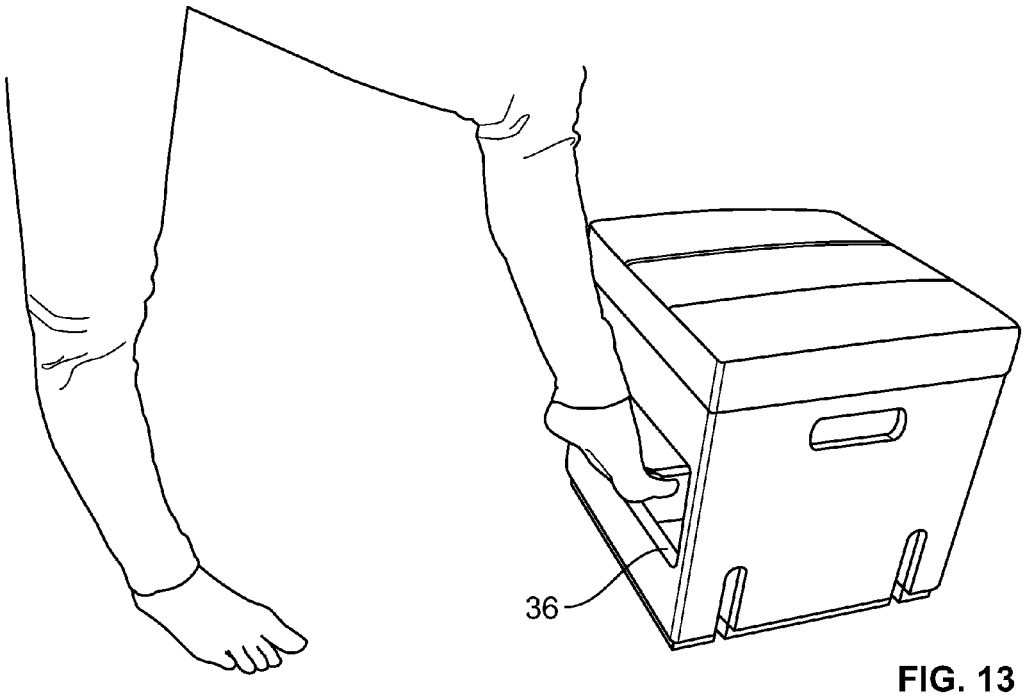
FIGS. 13-17 and 19 show a user standing near the stool and interacting with the stool in a respective plurality of positions.

FIG. 13 shows the user with the left toes hooked on the rear window slot 36 for stretching the left leg.

Figure 14:
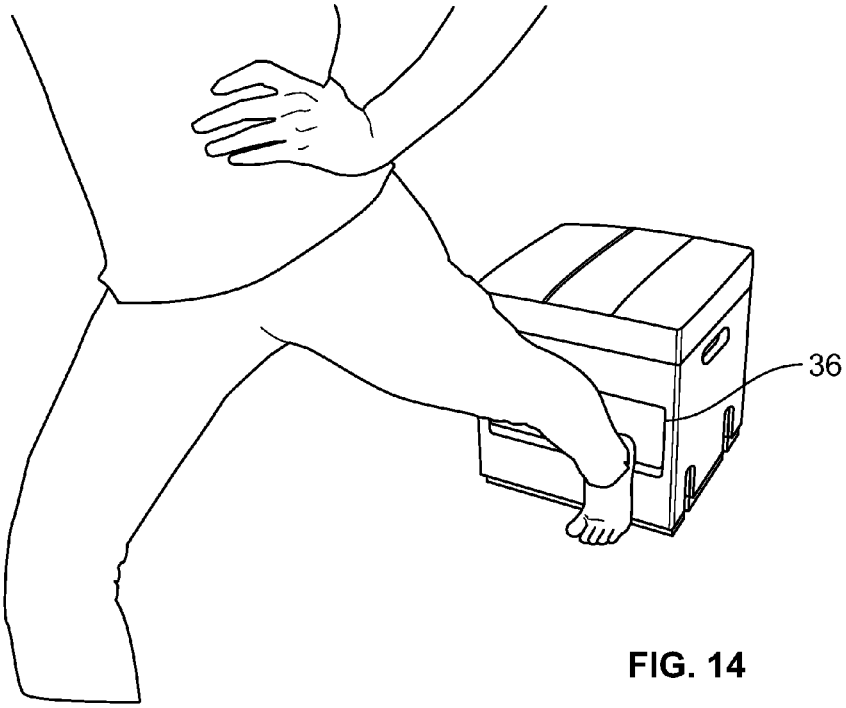

FIG. 14 shows the user with the left heel hooked on the rear window slot 36 for performing another leg stretch.

Figure 15:
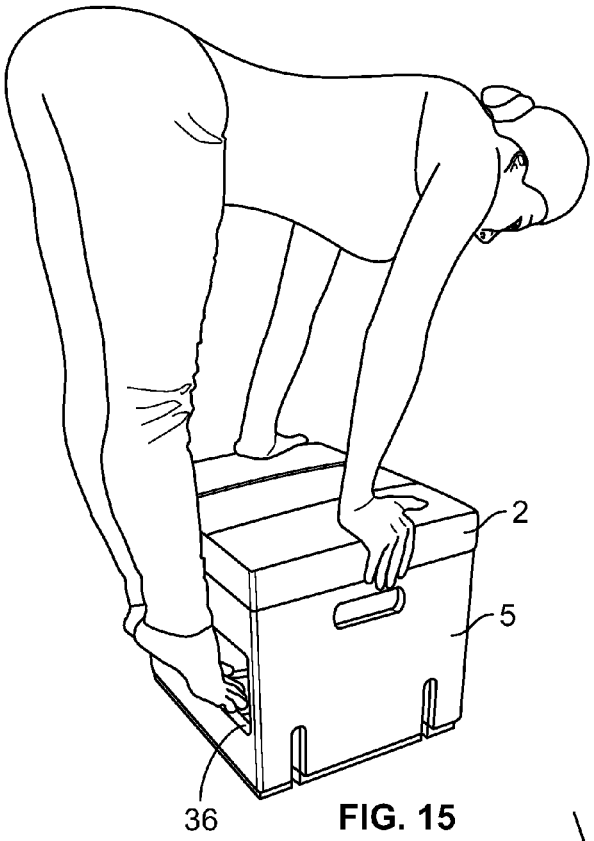
Figure 16:
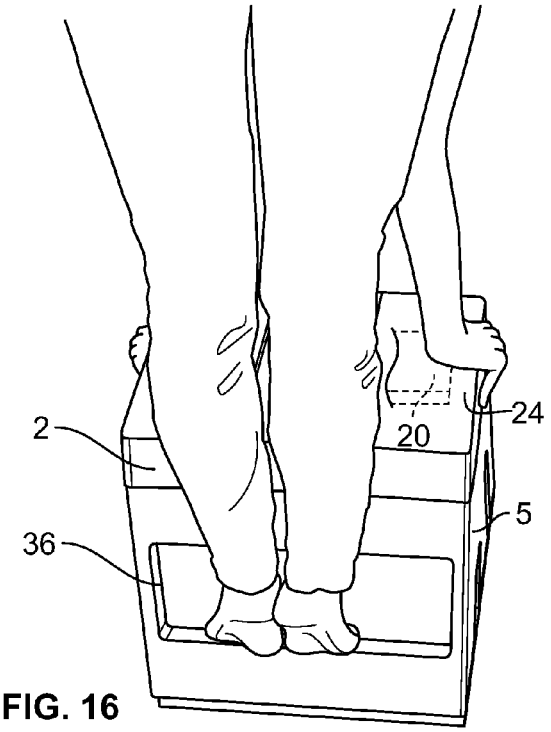

FIGS. 15 and 16 are two views showing the user with the toes of both feet hooked on the rear window slot 36 and the right and left hands disposed respectively on the right and left sides of the seat 2. The wrist and the heels of the hands are supported respectively on the right and left ends of the slat 20 inside the seat 2. The remainder of the hands extends over the side portions 24 of the seat 2 where the slat 20 is not present.

Figure 17:
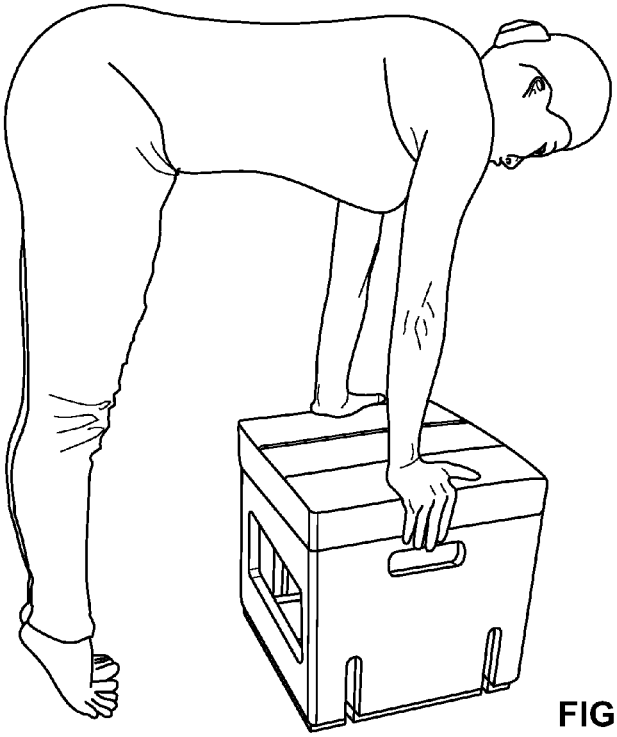

FIG. 17 is similar to FIGS. 15 and 16, but the feet have been moved away from the stool for performing a different stretch.

Figure 18:
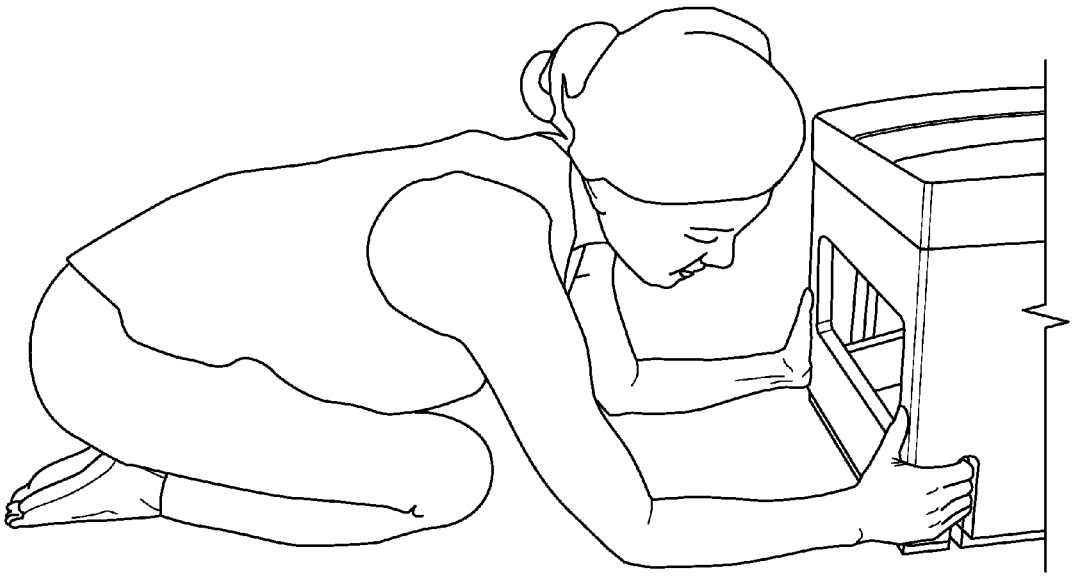
FIG. 18 shows a user kneeling near the stool and interacting with the stool.
Figure 19:
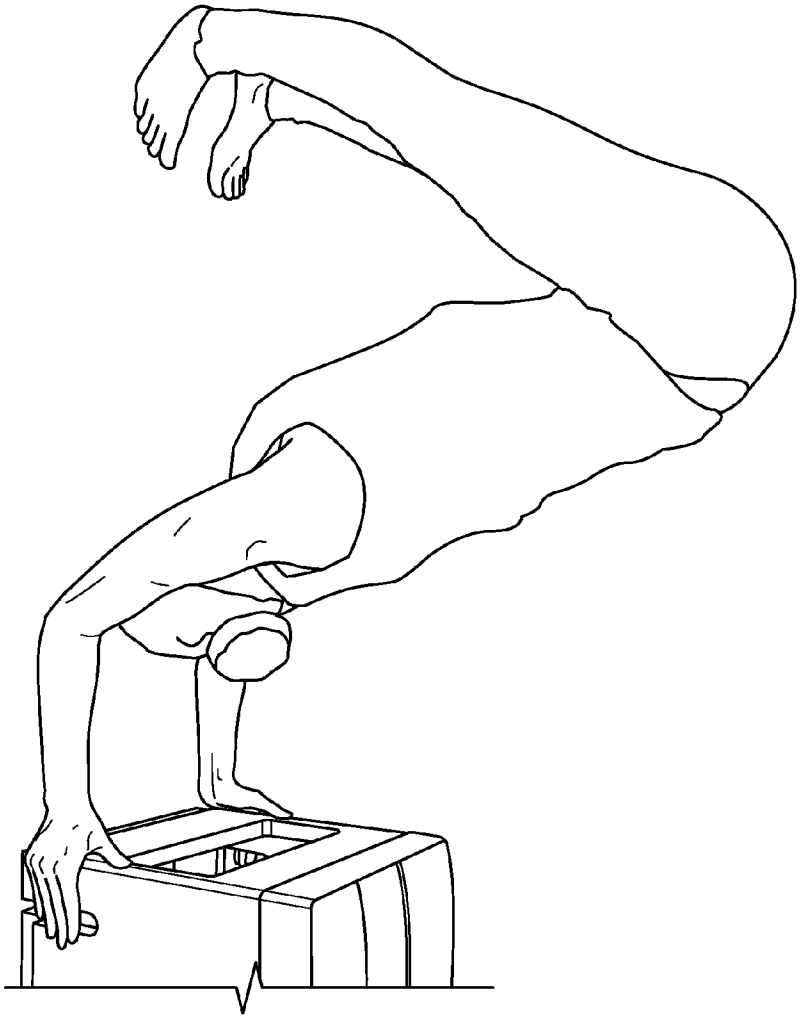

FIGS. 18 and 19 show the user gripping the vertical slots 30 at the bottom of the rear side 7 of the stool. In FIG. 18 the user is performing a kneeling posture, while in FIG. 19 the user is performing a forward bend.

Figure 20:
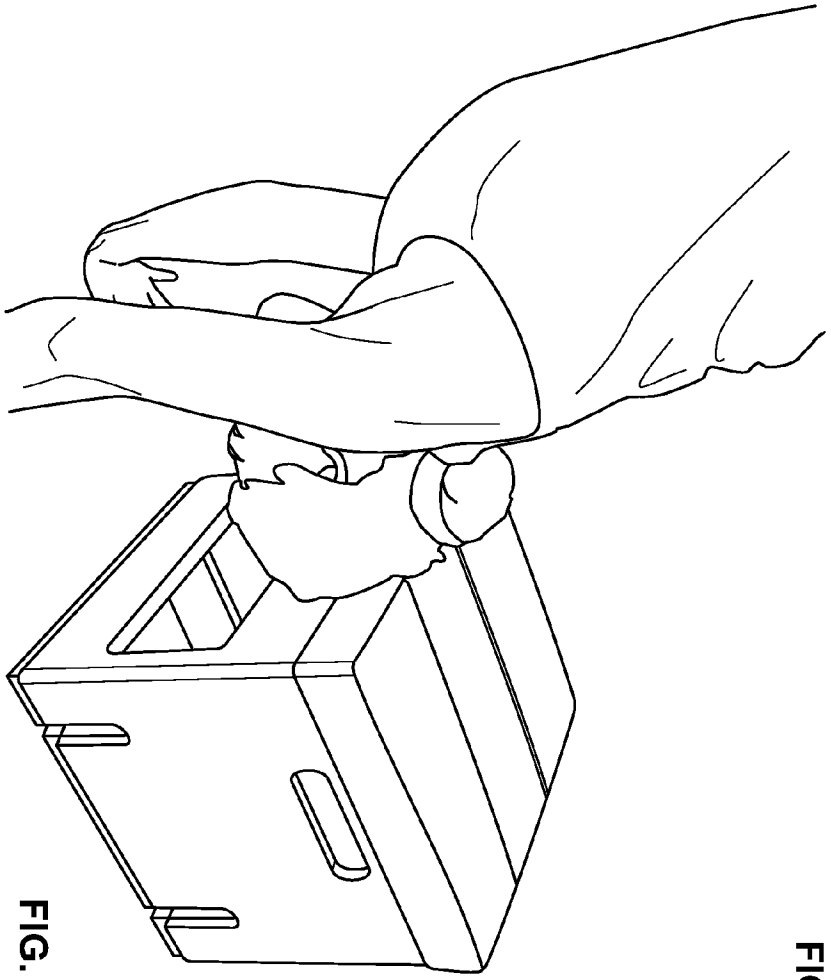
FIG. 20 shows a user performing a handstand near the stool and interacting with the stool.

FIG. 20 shows the user performing a headstand with the head braced against the rear side 7. A forearm stand may also be performed, with the hands gripping the handle slots 30 as in FIG. 18. In either of these stands, the yoga stool is advantageous because the legs can swing farther over the user's head than if the stand were performed against a wall, as is conventional. An indentation for the head may be provided on the rear side 7, the first side 4, and/or elsewhere.

Thus, the combination of elements and parts in the stool 1 provides great versatility in adapting to a wide variety of yoga positions.

In all of the positions illustrated, and other positions well known to those versed in yoga, but not shown herein, the stool 1 enhances the user's stability.

The drawings are not drawn to scale. The terms "front," "rear," etc. are assigned arbitrarily for purposes of this disclosure and to label the relative arrangement of the parts, but are not to be taken as limiting the structure or possible orientations of the yoga stool in actual use.

As shown and described herein, the arrangement of the seat, the handle slots, window slots and other parts has been developed by the inventor after extensive experimentation and constitutes the best known mode of practicing the invention.

Modification and variations of the disclosed stool, including alternative arrangements of slots, windows, contact areas and hand grips, may occur to those well-versed in yoga and are considered to be within the scope of the invention.

The invention claimed is:

1. A yoga stool comprising:

a seat portion and a base portion;

the base portion having opposed top and bottom sides, opposed left and right sides, and opposed front and rear sides;

a window slot formed in at least one of the front side and the rear side;

two horizontal gripping slots formed respectively in upper portions of the left side and the right side;

four vertical gripping slots formed respectively in lower portions of the left side and the right side, two of said slots being near or at the front side and two of the slots being near or at the back side, adjacent to and intersecting the bottom side of the base portion; and wherein said base portion further comprises a handle slot formed in the upper portion of at least one of the left, right, front and rear sides.

2. A yoga stool according to claim 1, wherein the bottom side is covered with a material for gripping the floor.

3. A yoga stool according to claim 1, wherein the seat portion has an internal horizontal firm support member, and soft material in the seat laterally surrounding the support member adjacent the left, right, front and rear sides.

4. A yoga stool according to claim 3, wherein the bottom side is covered with a material for gripping the floor.

5. A yoga stool according to claim 1, wherein all of the slots are lined with a material for providing a comfortable gripping contact for a user.

6. A yoga stool according to claim 5, wherein the material is rubber.

7. A yoga stool according to claim 1, wherein each of said vertical gripping slots further extends continuously from said left or right side and into said bottom side of the base portion.

8. The yoga stool of claim 1, wherein a top surface of the seat comprises a gripping material.

9. A yoga stool comprising:

a base having a top side for receiving a seat;

the base having a bottom side opposed to said top side, opposed left and right sides, and opposed front and rear sides;

horizontal handles located respectively at upper portions of two opposed sides of said stool; and vertical handles located respectively at lower portions of two opposed sides of said stool.

10. The yoga stool of claim 9, said vertical handles being located at the left and right sides of said stool, and near or at the front side or the back side of said stool.

11. The yoga stool of claim 10, wherein said vertical handles are adjacent to and intersect the bottom side of the base of said stool.

12. The yoga stool of claim 9, further comprising a seat disposed on the top side of the base.

13. The yoga stool of claim 9, wherein said horizontal and vertical handles comprise slots formed in said respective sides.

14. The yoga stool of claim 9, wherein a top surface of the seat comprises a gripping material.

15. A yoga stool comprising:

a base having a bottom, and a supporting portion extending upward from the bottom; and a horizontal seat disposed on top of the supporting portion of the base and extending generally horizontally for being sat upon by a user;

wherein a top surface of the seat comprises a gripping material; and wherein an interior of the seat below the top surface comprises a soft material.

16. A yoga stool according to claim 15, wherein the seat has an internal horizontal firm support member, and the soft material in the seat laterally surrounds the support member.

17. A yoga stool according to claim 16, wherein the soft material in the seat overlies the support member.

18. The yoga stool of claim 15, wherein the top surface of the seat comprises a pair of side strips of the gripping material extending across the seat.

19. The yoga stool of claim 18, wherein the pair of side strips extend in parallel from one side to an opposite side of the seat.

20. The yoga stool of claim 19, further comprising a middle strip extending across the seat between the pair of side strips.

* * * * *